US005362548A

United States Patent [19]

Hiyoshi et al.

[11] Patent Number: 5,362,548

[45] Date of Patent: Nov. 8, 1994

[54] THERMAL IMAGE TRANSFER RECORDING MEDIUM

[75] Inventors: Yoshihiko Hiyoshi, Shizuoka; Youji Ide, Mishima; Tetsuji Kunitake, Numazu; Nobuyuki Maeda, Susono; Kumi Surizaki, Numazu, all of Japan

[73] Assignee: Ricoh Company, Ltd., Tokyo, Japan

[21] Appl. No.: 882,583

[22] Filed: May 13, 1992

[30] Foreign Application Priority Data

May 14, 1991 [JP] Japan ..... 3-137062
Jun. 3, 1991 [JP] Japan ..... 3-131123
Jun. 4, 1991 [JP] Japan ..... 3-159446
Feb. 27, 1992 [JP] Japan ..... 4-075712

[51] Int. Cl.[5] ..... B41M 5/26

[52] U.S. Cl. ..... 428/195; 428/206; 428/212; 428/327; 428/412; 428/413; 428/473.5; 428/480; 428/484; 428/488.1; 428/500; 428/520; 428/520; 428/913; 428/914; 156/234

[58] Field of Search ..... 428/195, 212, 206, 207, 428/327, 484, 488.1, 488.4, 913, 914, 412, 413, 473.5, 480, 500, 520; 156/234

[56] References Cited

U.S. PATENT DOCUMENTS 4,777,079 10/1988 Nagamoto et al. ..... 428/195
4,818,605 4/1989 Suzuki et al. ..... 428/321.3
4,828,904 5/1989 Shiraishi et al. ..... 428/195
4,965,124 10/1990 Shiraishi et al. ..... 428/195
5,229,189 7/1993 Hiyoshi et al. ..... 428/195

OTHER PUBLICATIONS

Derwent Abstract 88-094924/14 of JP 63-45091.
Derwent Abstract 88-101611/15 of JP 63-51180.

*Primary Examiner*—Patrick J. Ryan
*Assistant Examiner*—William A. Krynski

[57] ABSTRACT

A thermal image transfer recording medium is composed of a support, and a thermofusible ink layer formed on the support, the thermofusible ink layer containing a thermofusible material with a loaded needle penetration of 2 or less at 25° C., and a coloring agent, and having a shearing strength of 8 to 20 gf/cm at 20° C., and an adhesion strength of 1.0 to 2.0 gf/cm with respect to the support. The thermofusible ink layer can be composed of a first ink layer formed thereon, comprising finely-divided particles of a thermofusible material with a loaded needle penetration of 2 or less at 25° C. and an average particle diameter in the range of 0.5 to 3.0 μm, with a voidage of 5 to 30 vol. %, and a second ink layer formed on the first ink layer, composed of a thermofusible material with a loaded needle penetration of 2 or less at 25° C., which may be in the form of finely-divided particles, and a coloring agent.

22 Claims, 4 Drawing Sheets

THERMAL IMAGE TRANSFER RECORDING MEDIUM

BACKGROUND OF THE INVENTION

1. Field of the Invention

The present invention relates to a thermal image transfer recording medium, and more particularly to a thermal image transfer recording medium for use with a high speed bar code printer, comprising a support, a first ink layer formed thereon, and a second ink layer formed on the first ink layer, capable of easily attaining excellent image transfer onto an image-receiving sheet with the application of a small amount of thermal energy thereto, producing clear, abrasion-resistant images even on an image-receiving sheet with a low smoothness, such as regenerated paper with a smoothness as low as 50 to 150 sec in terms of Bekk's smoothness.

2. Discussion of Background

Recently a thermal image transfer recording system using a thermal head is widely used because of the advantages that it is noiseless, the apparatus for use in the system is relatively inexpensive and can be made small in size, the maintenance is easy, and printed images are stable in quality.

Thermal printing by use of such a thermal image transfer recording system is conducted by bringing a thermal image transfer recording medium into close contact with an image-receiving sheet by a thermal head including a number of heating elements, and activating the required heating elements corresponding to the required portions to be heated of the thermal image transfer recording medium, so that the heated portions of the thermofusible ink layer provided on a support are fused and transferred to the image-receiving sheet.

Representative examples of thermal image transfer recording media for use with such a thermal image transfer recording system are as follows:

(1) A thermal image transfer recording medium comprising a support and a thermofusible ink layer which comprises a coloring agent and a binder agent and is directly provided on the support.

(2) A thermal image transfer recording medium comprising a support, a release layer provided on the support, and a thermofusible ink layer overlaid on the release layer. The release layer consists essentially of a wax component, and the thermofusible ink layer consists essentially of a coloring agent and a binder agent.

The binder agent contained in the thermofusible ink layer for the above-mentioned recording medium (1), the release layer of the recording medium (2), and the binder agent in the thermofusible ink layer for the recording medium (2), consist essentially of a wax component. The thermofusible ink layers for the recording media (1) and (2) and the release layer for the recording medium (2) generally further comprise a resin such as ethylene-vinyl acetate copolymer, polyamide, or polystyrene, in order to prevent the thermofusible ink layer from peeling off the support. The addition of the above-mentioned resin improves the shearing strength of the thermofusible ink layer or that of the combination of the thermofusible ink layer and the release layer.

When thermal printing is performed by use of the above-mentioned recording medium, particularly on a sheet of paper with a smoothness as low as 50 to 150 sec in terms of Bekk's smoothness, such as regenerated paper, for example, as shown in FIG. 3, when a thermal image transfer recording medium 1 which comprises a film support 2 and a thermofusible ink layer 3 provided thereon is brought into close contact with an image-receiving sheet 8 in such a manner that the thermofusible ink layer 3 comes into contact with the image-receiving sheet 8, and a thermal head 6 is brought into contact with the film support 2 of the thermal image transfer medium 1, so that heat is applied from the thermal head 6 to the thermofusible ink layer 3 through the film support 2, it is considered that an ink portion 7 of the thermofusible ink layer 3 is fused by the application of heat by the thermal head 6, transferred to the image-receiving sheet 8, and fixed thereto. However when the transferred ink portion 7 is cooled and solidified, even if it is tried to separate the solidified ink portion 7 from the film support 2, the ink portion 7 in fact still adheres to the film support 2, and is not transferred to the image-receiving sheet 8, so that the so-called voids are formed in the images obtained because of the insufficient image transfer performance of the thermal image transfer recording medium 1.

This is because the total of the shearing strength F1 between the solidified ink portion 7 and the non-heated portions 9, and the adhesion strength F2 between the film support 2 and the thermofusible ink layer 3 are larger than the image fixing force F3 of the ink portion 7 which is to be fixed onto the image-receiving sheet 8.

As the wax components for use in each of the thermofusible ink layer for the recording medium (1), the release layer, and the thermofusible ink layer for the recording medium (2), inexpensive petroleum waxes with low loaded needle penetrations are conventionally employed.

In the case where such petroleum waxes are employed as the wax component for the thermofusible ink layer or for the release layer, the transferred ink images are easily blurred or come off the image-receiving sheet when touched with the finger or scratched with a pen-type scanner, which would cause a serious problem when used in the field of industrial bar codes.

Furthermore, in the case where the above-mentioned thermal image transfer recording medium (1) is used for image recording on an image-receiving sheet, a satisfactory image quality cannot be obtained unless the image-receiving sheet has a smoothness as high as 1000 sec or more in terms of Bekk's smoothness.

Moreover, a large amount of a pigment such as carbon black has to be contained in the thermofusible ink layer of the above-mentioned recording medium (1) to obtain an appropriate image density, so that the pigment tends to be exposed on the image-transferred surface of the image-receiving sheets. Therefore, when the image-receiving surface comes into contact with the finger, or is scratched with a corrugated card board or a pen-type scanner, the image receiving sheet is smeared with the pigments and the bar codes printed on the image transfer sheet become illegible.

On the other hand, when the thermal image transfer recording medium (2) is employed, the image transfer to an image-receiving sheet can be easily performed because of the presence of the release layer to produce high quality images even if the image-receiving sheet has a smoothness 400 to 500 sec in terms of Bekk's smoothness.

However, these image-receiving sheets are expensive and disadvantageous from the viewpoint of running cost since such image-receiving sheets with a smoothness of 400 to 500 sec in terms of Bekk's smoothness are, for example, resin-coated plain paper and a calendered paper.

Moreover, in the release layer used in the thermal image transfer recording medium (2), a wax component with relatively large endotherm is employed. Therefore, it is difficult to apply a sufficient amount of thermal energy to the release layer for fusing and transferring the release layer to the image receiving sheet for use with a high-speed printer. Therefore, this type of recording medium has the risk that improper printing is caused in particular in high speed recording.

Furthermore, the presence of the release layer in the recording medium (2) prevents the pigment in the ink layer from being exposed on the surface of the obtained image after the printing operation. Therefore, the recording medium (2) is superior to the recording medium (1) with respect to the frictional resistance of the images obtained. However, the wax component contained as the main component in the release layer is too soft to obtain images with satisfactory frictional resistance. These cause serious problems when such recording media are used in industries.

In order to improve the frictional resistance of the image obtained by use of the conventional thermal image transfer recording media, the following media have been proposed:

1) a thermal image transfer recording medium comprising an ink layer comprising as the main components a coloring agent, resin particles with a melting point or softening point of 60° to 140° C., a wax component with a melting point or softening point of 70° to 130° C., and a water-soluble resin (Japanese Laid-Open Patent Application 63-45091);
2) a thermal image transfer recording medium comprising an ink layer comprising as the main components (a) solid solution particles comprising a resin and a wax, (b) a coloring agent, and (c) a binder agent (Japanese Laid-Open Patent Application 63-84980);
3) a thermal image transfer recording medium which comprises a first ink layer comprising as the main components styrene-based resin particles and a wax component, and a second ink layer overlaid on the first ink layer comprising a coloring agent, adhesiveness-imparting resin particles, and a wax (Japanese Laid-Open Patent Application 63-84981);
4) a thermal image transfer recording medium having a ink layer comprising a coloring agent, thermoplastic resin particles, wax particles, and a water-soluble resin (Japanese Laid-Open Patent Application 63-89383); and
5) a thermal image transfer recording medium which comprises a first ink layer and a second ink layer each comprising thermofusible resin particles (Japanese Laid-Open Patent Application 63-51180).

In the above-mentioned conventional thermal image transfer recording media (1) to (4), each component for the ink layers is in the form of particles, so that a printed area and a non-printed area in each ink layer can be sharply separated in the course of image transfer, thus the resolution of the transferred image can be improved. However these recording media have the shortcomings that the thermofusible ink layer tends to be easily peeled off the support because of the poor adhesion thereof to the support, smearing the background of printed images with the peeled ink layer, and that the thermosensitivity of the recording medium and the frictional resistance of the obtained images are insufficient for use in practice.

The thermosensitivity of the thermal image transfer recording medium (5) is better than the thermosensitivities of the recording media of (1) to (4), but the thermal response thereof is still insufficient for use in practice, particularly for high speed printing, and the high density recording. The frictional resistance thereof is also poor.

SUMMARY OF THE INVENTION

It is therefore an object of the present invention to provide a thermal image transfer recording medium free from the above-mentioned shortcomings of the conventional thermal image transfer recording media, capable of easily producing clear-cut images, with high thermosensitivity, even on image-receiving sheets with a low smoothness, whose running cost is low.

Another object of the present invention is to provide a thermal image transfer recording medium, which has excellent in the thermosensitivity and image transfer performance, and is capable of producing images with excellent frictional resistance even on an image-receiving sheet with a low smoothness.

These objects of the present invention can be achieved by a thermal image transfer recording medium comprising a support, and a thermofusible ink layer formed thereon, the thermofusible ink layer comprising a thermofusible material with a loaded needle penetration of 2 or less at 25° C., and a coloring agent, and having a shearing strength of 8 to 20 gf/cm at 20° C., and an adhesion strength of 1.0 to 2.0 gf/cm with respect to the support.

The above thermofusible ink layer may comprise a first ink layer comprising the thermofusible material formed on the support and a second ink layer comprising the thermo-fusible material and the coloring agent formed on the first ink layer.

Furthermore, the thermofusible material may be in the form of finely-divided thermofusible particles at least in the first ink layer.

The above objects of the present invention can also be achieved by a thermal image transfer recording medium which comprises a support, a first ink layer formed thereon, comprising finely-divided particles of a thermofusible material with a loaded needle penetration of 2 or less at 25° C., and an average particle diameter in the range of 0.5 to 3.0 μm, with a voidage of 5 to 30 vol. %, and a second ink layer formed on the first ink layer, comprising a thermo-fusible material with a loaded needle penetration of 2 or less at 25° C., and a coloring agent. The thermofusible material in the second ink layer may be in the form of finely-divided particles. In this case, the average particle diameter of the finely-divided particles of the thermofusible material in the second ink layer is smaller than that of the finely-divided particles of the thermofusible material in the first ink layer.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawing, wherein.

DESCRIPTION OF THE PREFERRED EMBODIMENTS

With reference to the accompanying drawings, the present invention will now be explained in more detail.

Figure 1:
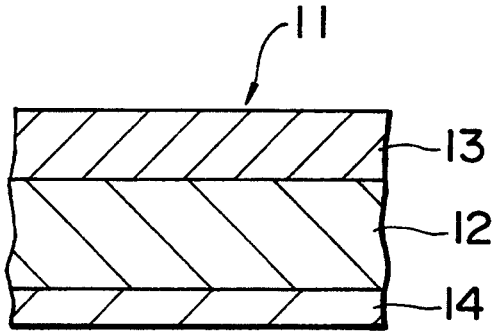
FIG. 1 is a schematic partial cross-sectional view of an example of a thermal image transfer recording medium according to the present invention.

FIG. 1 is a schematic cross-sectional view of an example of a thermal image transfer recording medium 11 of the present invention, which comprises a film support 12, a thermofusible ink layer 13 provided on the film support 12, and a heat resistant and/or lubricating, protective layer 14 which is provided on the back side of the film support 12 opposite to the ink layer 13 with respect to the support 12.

Figure 2:
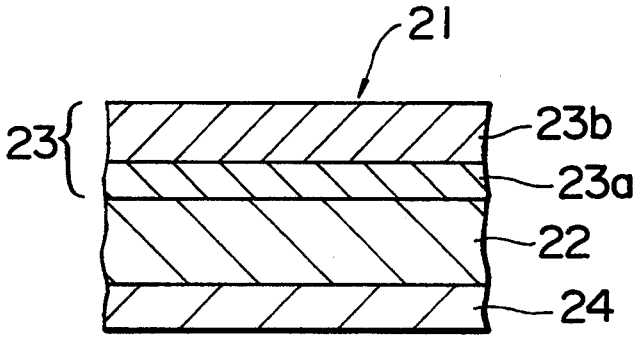
FIG. 2 is a schematic partial cross-sectional view of another example of a thermal image transfer recording medium according to the present invention.

FIG. 2 is a schematic cross-sectional view of another example of a thermal image transfer recording medium 21 of the present invention, which comprises a film support 22, a thermofusible ink layer 23 provided on the film support 22, and a heat resistant and/or lubricating, protective layer 24 which is formed on the back side of the support 22. The thermofusible ink layer 23 comprises a first ink layer **23*a* serving as a release layer, and a second ink layer 23*b* overlaid on the first ink layer 23*a***.

Figure 4:
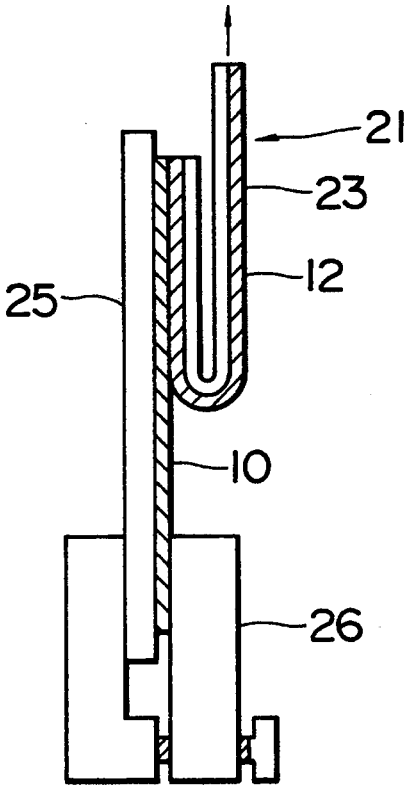
FIG. 4 is a schematic diagram in explanation of the measurement of the shearing strength and adhesion strength of a thermofusible ink layer of a thermal image transfer recording medium of the present invention by use of a tensilon tensile and compression tester.

FIG. 4 is a schematic vertical cross-sectional view of a commercially available tensilon tensile and compression tester (Trademark "TCM-200 CR Type" made by Minebea Co., Ltd.) for measuring the shearing strength and the adhesion strength of the thermofusible ink layer of such thermal image transfer recording media as mentioned above.

The method of measuring the shearing strength of the thermofusible ink layer 23 which is composed of the first ink layer **23*a* serving as a release layer and and the second ink layer 23*b* as shown in FIG. 2, and the adhesion strength of the thermofusible ink layer 23 to the support 22** will now be explained with reference to FIG. 4.

In the figure, reference numeral 21 indicates a test piece of the thermal image transfer recording medium; and reference numeral 10, an adhesive tape (18 mm×35 mm) including an adhesive layer which is commercially available from Nichiban Co., Ltd. The adhesive layer of the adhesive tape 10 is directed to the thermofusible ink layer 23. As mentioned above, the thermofusible ink layer 23 is formed on the support 22 and composed of the first ink layer **23*a* formed on the support 22 and the second ink layer 23*b* overlaid on the first ink layer 23*a*. Reference numeral 25 indicates a reinforcement plate on which the adhesive tape 10 is placed. In this case, a thick stainless steel plate is employed as the reinforcement plate 25. Reference number 26** indicates a fixing member.

The shearing strength and the adhesion strength of the thermofusible ink layer 23 were measured by applying the thermal image transfer recording medium 21 to the adhesive tape 10 in such a manner that the ink layer 23 was in contact with the adhesive layer of the adhesive tape 10, and then by peeling the thermal image transfer recording medium 21 off the adhesive layer 10 under the following conditions:

Peeling Angle: 180°
Peeling Speed: 50 mm/min
Width of the Test Piece: 10 mm
Ambient Temperature: 20° C.

The above-mentioned shearing strength is the force applied to the thermal image transfer recording medium 21 when the thermal image transfer recording medium 21 begins to be peeled off the adhesive tape 10 in such a manner that only the first ink layer **23*a* and the second ink layer 23*b* remain on the adhesive tape 10, and the adhesion strength is the force applied to the thermal image transfer recording medium 21 after the thermal image transfer recording medium 21 has begun to be peeled off the adhesive tape 10 in such a manner that the first ink layer 23*a* and the second ink layer 23*b* remain on the adhesive tape 10, and such peeling of the first ink layer 23*a* and the second ink layer 23*b*** is being continued.

The support 12, 22 can be made of a material, for example, a plastic film with comparatively high heat resistance such as polyester, polycarbonate, triacetyl cellulose, polyamide, and polyimide. In addition to the above, cellophane, parchment paper, glassine paper, condenser paper, and metallic foils can be employed as the material for the support 12, 22. It is preferable that the support 12, 22 have a thickness of about 2 to 15 μm, more preferably about 3 to 10 μm.

Examples of the material for the heat-resistant and/or lubricating, protective layer 14, 24 with which a thermal head comes into contact include silicone resin, silicone rubber, silicone-modified resin, fluorocarbon resin, polyimide resin, epoxy resin, phenolic resin, melamine resin and cellulose-based resins such as nitrocellulose.

The provision of the heat-resistant and/or lubricating protective layer 14, 24 not only improves the heat resistance and lubricating properties of the support 12, 22, but also makes it possible to use a material for the support 12, 22 which is not conventionally employed as the material for the support 12, 22.

The thermofusible ink layer 13 or 23 comprises a thermofusible material with a loaded needle penetration of 2 or less at 25° C., and a coloring agent. The thermofusible material may further comprise a resin component.

Representative example of the thermofusible material for use in the thermofusible ink layer 13 or 23 are waxes and wax-like materials such as paraffin wax, microcystalline wax, oxidized paraffin wax, candelilla wax, carnauba wax, montan wax, cersine wax, polyethylene wax, oxidized poly-ethylene wax, castor wax, beef tallow hardened oil, lanolin, Japan wax, sorbitan stearate, sorbitan palmitate, stearyl alcohol, polyamide wax, oleylamide wax, stearylamide, hydroxystearic acid, synthesized ester wax, synthesized lanolin derivative wax, and synthesized alloy waxes. These may be employed alone or in combination. Most of the above thermofusible materials have melting points in the range of 40° to 100° C.

Of the above thermofusible materials, waxes having a loaded needle penetration of 2 or less at 25° C., such as carnauba wax with a loaded needle penetration of 1 or less at 25° C., candelilla wax with a loaded needle penetration of about 1 at 25° C., and synthesized lanolin derivative wax with a loaded needle penetration of about 2 at 25° C., are more preferable for use in the thermofusible ink layer 13 or 23.

When a wax with a loaded needle penetration of more than 2 is employed as the main component of the thermofusible ink layer 13 or 23, the surface of the transferred image becomes so soft that there is a problem in that the obtained image becomes blurred and illegible when rubbed with the finger or a pen-type scanner.

As the resin component for use in the thermofusible material, the following resins can be used: an elastomer such as rubber, and resins such as polyamide-based resin, polyester-based resin, polyurethane-based resin, vinyl chloride-based resin, cellulose-based resin, petroleum-based resin, styrene-based resin, butyral-based resin, phenolic resin, ethylene-vinyl acetate copolymer, ethylene-acrylic resin, and terpene resin.

As the coloring agent for use in the thermofusible ink layer 13 or 23, dyes and pigments which are conventionally employed in the field of thermal image transfer recording can be employed.

In the thermofusible ink layer 13 or 23, it is preferable that the amount ratio by weight of the coloring agent/the wax component/the resin component be 50–50/30–90/5–50.

The thermofusible ink layer 13 or 23 may further comprise conventional plastisizers and oils such as fatty acid ester, glycol ester, phosphoric ester, and epoxidized linseed oil in an amount of 30 wt. % or less of the entire weight of the thermofusible ink layer 13 or 23.

The thermofusible ink layer 13 or the ink layer **23*b*** can be formed by a hot melt method or by coating a solution or dispersion of the components for the layer and then drying the coated solution or dispersion.

A thermofusible ink layer with a shearing strength of 8–20 gf/cm at 20° C. can be formed by dispersing the thermofusible material in a poor solvent such as water to prepare a dispersion in which the finely-divided particles of the thermofusible material are dispersed, with inclusion of a coloring agent, and coating the dispersion on the support 12, and drying the same form a thermofusible ink layer 13 on the support, which contains the thermofusible material in the form of finely-divided particles.

In order to impart an adhesion strength of 1.0 to 2.0 gf/cm to the thermofusible ink layer, it is preferable to add an elastomer such as rubber to the thermofusible ink layer. In order to impart the above-mentioned shearing strength and the adhesion strength to the thermofusible ink layer, it is preferable to use a rubber latex dispersed in an aqueous solvent.

Specific examples of the elastomer are synthetic rubbers and natural rubbers such as butadiene rubber, styrene-butadiene rubber, nitrile rubber, nitrile-butadiene rubber, high-styrene rubber, isoprene rubber, acrylic rubber, epichlorohydrin rubber, butyl rubber, and ethylene-propylene rubber.

It is preferable that the thermofusible ink layer 13 as shown in FIG. 1 have a thickness of 1 to 10 μm, more preferably a thickness of 2 to 6 μm, and that the second ink layer **23*b* as shown in FIG. 2** have a thickness of 1.5 to 3 μm for imparting the above-mentioned shearing strength and adhesion strength and for attaining image transfer with appropriate high, uniform image density even onto a relatively rough image-receiving sheet.

In the thermal image transfer recording medium as shown in FIG. 2, the first ink layer **23*a* comprises a thermofusible material which is the same as those employed in the thermofusible ink layer 13**.

When necessary, for example, an elastomer such as rubber, resins such as polyvinyl butyral, vinyl chloride-vinyl acetate copolymer, nitrocellulose, epoxy resin, ethylene-vinyl acetate copolymer, ethylene-α-olefin copolymer, α-olefin-maleic anhydride copolymer, ethylene-methacrylic acid copolymer, and ethyl cellulose may be added individually or in combination to the ink layer **23*a***.

The thermofusible ink layer 23 composed of the first ink layer **23*a* and the second ink layer 23*b* with a shearing strength of 8–20 gf/cm at 20° C. can be formed as follows: The thermofusible material is dispersed in a poor solvent such as water to prepare a dispersion in which the finely-divided particles of the thermofusible material are dispersed. The dispersion is coated on the support 22, and dried to form the ink layer 23*a* on the support 22. The ink layer 23*a* contains the thermofusible material in the form of finely-divided particles. The second ink layer 23*b* is then provided on the first ink layer 23*a*** by the conventional coating method or hot-melt method.

In order to impart an adhesion strength of 1.0 to 2.0 gf/cm to the thermofusible ink layer 23, it is preferable to add the same elastomer as employed in the thermofusible ink layer 13 to the ink layer **23*a*. In order to impart the above-mentioned shearing strength and the adhesion strength to the thermofusible ink layer 23**, it is preferable to use a rubber latex dispersed in an aqueous solvent.

It is preferable that the first ink layer **23*a* have a thickness of 0.5 to 10 μm, more preferably a thickness of 1 to 3 μm, to obtain the best performance of the first ink layer 23*a*** as release layer, thereby attaining image transfer with appropriate high and uniform image density even onto a relatively rough image-receiving sheet.

In the present invention, in the case where the thermofusible ink layer 13 or the thermofusible ink layer 23 composed of the first ink layer **23*a* and the second ink layer 23*b*** has a shearing strength less than 8 gf/cm at 20° C., and an adhesion strength less than 1.0 gf/cm, not only the peeling of the ink layer off the support, but also the transfer of the printed portions and non-printed portions of the ink layer to an image receiving sheet occurs, in particular when the thermal image transfer recording medium is transported at an angle of 90° with respect to the printing direction when ladder bar codes are printed. The result is that the printed bar codes become illegible.

Figure 3:
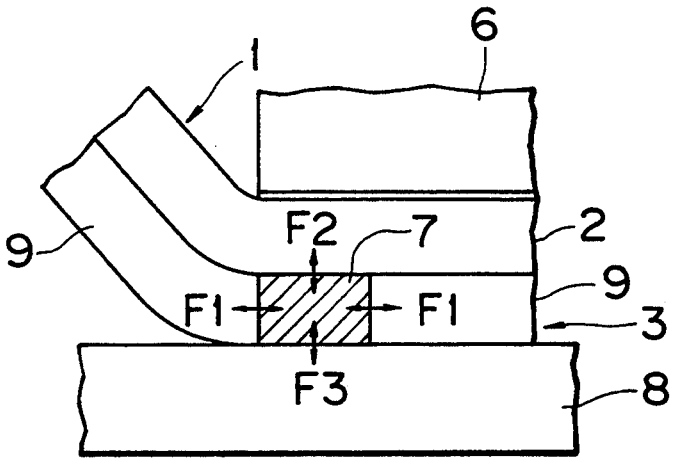
FIG. 3 is a schematic diagram in explanation of a thermofusible ink layer of a thermal image transfer recording medium to an image-receiving sheet.

On the other hand, in the case where the the thermofusible ink layer 13 or 23 has a shearing strength more than 20 gf/cm at 20° C., and an adhesion strength more than 2.0 gf/cm, the voids are formed in the printed images as previously explained with reference to FIG. 3.

Figure 5:
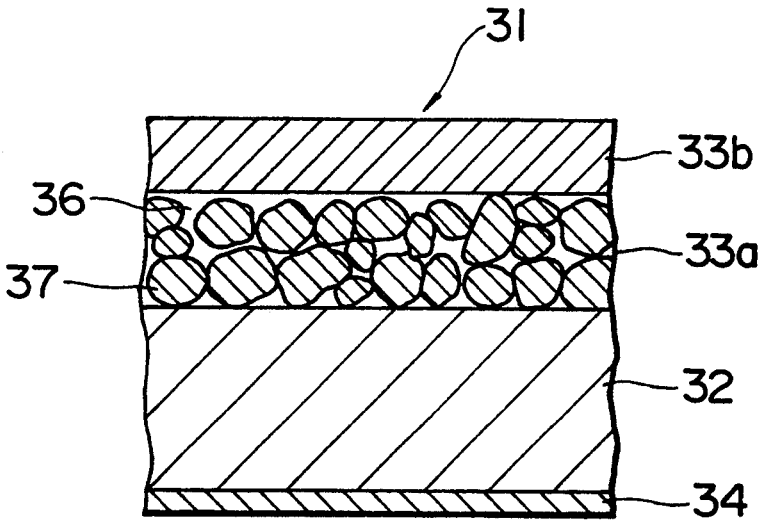
FIG. 5 is a schematic partial cross-sectional view of a further example of a thermal image transfer recording medium according to the present invention.

FIG. 5 is a schematic cross-sectional view of a further example of a thermal image transfer recording medium 31 of the present invention, which comprises a film support 32, a first ink layer 33*a* formed on the film support 32, and a second ink layer 33*b* formed on the first ink layer 33*a*. A heat-resistant protective layer 34 may be provided on the back side of the film support 32. A thermal head (not shown) comes into contact with the heat-resistant protective layer 34 which is substantially the same as the heat resistant and/or lubricating, protective layer 14, 24, respectively shown in FIG. 1 and FIG. 2. With the provision of the heat-resistant protective layer 34, the heat resistance of the film support 32 is improved.

The film support 32 is the same as the film support 14 shown in FIG. 1 and FIG. 2.

The first ink layer 33*a* comprises finely-divided particles 37 of the same thermofusible material as employed in the thermofusible ink layers 13 and 23 as shown in FIG. 1 and FIG. 2, respectively, having a loaded needle penetration of 2 or less at 25° C. The particles of the thermofusible material have an average particle diameter in the range of 0.5 to 3.0 μm. It is preferable that the first ink layer 33*a* have a voidage of 5 to 30 vol. %.

When the average particle diameter of the thermofusible material particles is less than 0.5 μm, it is difficult to prepare the first ink layer 33*a* with the above voidage and to obtain a thermal image transfer recording medium with satisfactory thermosensitivity and image transfer performance for use in practice.

On the other hand, when the average particle diameter of the finely-divided particles of the thermofusible material is more than 3.0 μm, the thermofusible properties of the first ink layer 33*a* are so poor that the images obtained tend to have voids. Further, in this case, the contact surface area of the support 32 and the first ink layer 33*a* is small and accordingly the adhesion strength between the support. 32 and the first ink layer 33*a* is reduced, so that the first and second ink layers 33*a* and 33*b* are easily peeled off the support 32.

It is preferable that the thickness of the first ink layer 33*a* be in the range of 0.5 to 5.0 μm, and more preferably in the range of 1.0 to 2.5 μm, for obtaining satisfactory image transfer performance when an image-receiving sheet with a lower smoothness is used or when image transfer is carried out under the application of low thermal energy.

The first ink layer 33*a* can be prepared by dispersing the thermofusible material such as any of the previously mentioned waxes in a poor solvent such as water to obtain a dispersion in which the thermofusible material is dispersed in the form of finely-divided particles, coating the dispersion on the support 32, and drying the coated dispersion to evaporate the solvent, thereby forming the first ink layer with the above-mentioned voidage.

When necessary, an elastomer such as rubber, resins such as polyvinyl butyral, vinyl chloride-vinyl acetate copolymer, nitrocellulose, epoxy resin, ethylene-vinyl acetate copolymer, ethylene-α-olefin copolymer, α-olefin-maleic anhydride copolymer, ethylene-methacrylic acid copolymer, and ethyl cellulose may be added individually or in combination to the first ink layer 33*a*.

The second ink layer 33*b* may be substantially the same as the thermofusible ink layer 13 in FIG. 1 and the second ink layer 23*b* in FIG. 2 and can be prepared in the same manner as in the case of the thermofusible ink layer 13 in FIG. 1 or the second ink layer 23*b* in FIG. 2. Furthermore, it is preferable that the thickness of the second ink layer 33*b* be in the range of 0.5 μm to 2.5 μm.

More specifically, the second ink layer 33*b* comprises a thermofusible material with a loaded needle penetration of 2 or less at 25° C., and a coloring agent. The thermofusible material may further comprise a resin component.

Representative example of the thermofusible material for use in the second ink layer are waxes and wax-like materials such as paraffin wax, microcystalline wax, oxidized paraffin wax, candelilla wax, carnauba wax, montan wax, cersine wax, polyethylene wax, oxidized polyethylene wax, castor wax, beef tallow hardened oil, lanolin, Japan wax, sorbitan stearate, sorbitan palmitate, stearyl alcohol, polyamide wax, oleylamide wax, stearylamide, hydroxystearic acid, synthesized ester wax, synthesized lanolin derivative wax, and synthesized alloy waxes. These may be employed alone or in combination.

As the resin component for use in the thermofusible material, the following resins can be used: an elastomer such as rubber, and resins such as polyamide-based resin, polyester-based resin, polyurethane-based resin, vinyl chloride-based resin, cellulose-based resin, petroleum-based resin, styrene-based resin, butyral-based resin, phenolic resin, ethylene-vinyl acetate copolymer, ethylene-acrylic resin, and terpene resin.

As the coloring agent for use in the second ink layer 33*b*, dyes and pigments which are conventionally employed in the field of thermal image transfer recording can be employed.

In the second ink layer 33*b*, it is preferable that the amount ratio by weight of the coloring agent/the wax component/the resin component be 5–50/30–90/5–50.

The second ink layer 33*b* may further comprise conventional plastisizers and oils such as fatty acid ester, glycol ester, phosphoric ester, and epoxidized linseed oil in an amount of 30 wt. % or less of the entire weight of the second ink layer 33*b*.

The second ink layer 33*b* can be formed by a hot melt method or by coating a solution or dispersion of the components for the layer and then drying the coated solution or dispersion.

A second ink layer comprising the previously mentioned thermofusible material in the form of finely-divided particles can also be employed instead of the above-mentioned second ink layer 33*b*.

Figure 6:
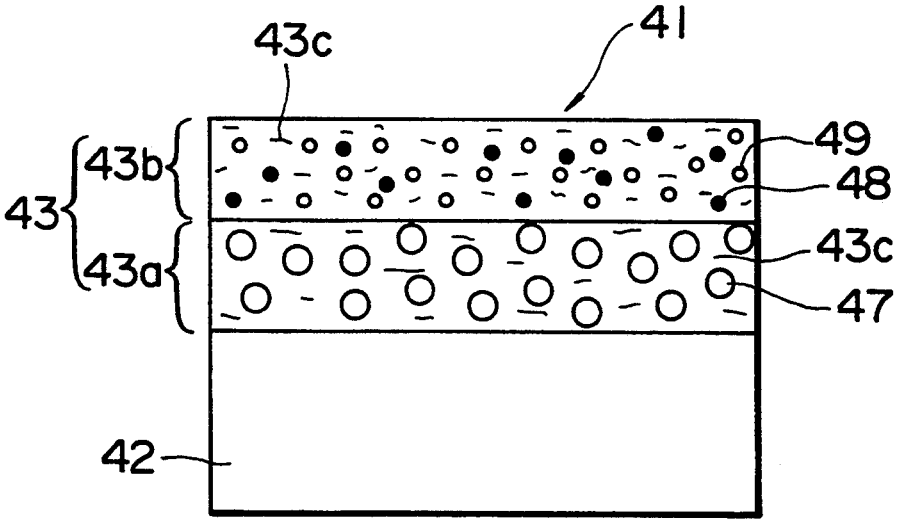
FIG. 6 is a schematic partial cross-sectional view of still another example of a thermal image transfer recording medium according to the present invention.

FIG. 6 shows a further example of a thermal image transfer recording medium 41 according to the present invention, which includes a second ink layer of the above-mentioned type. More specifically, the thermal image transfer recording medium 41 comprises a support 42, a first ink layer 43*a* provided on the support 42, a second ink layer 43*b* of the above-mentioned type formed on the first ink layer 43*a*.

In the thermal image transfer recording medium shown in FIG. 6, the first ink layer 43*a* comprises a thermofusible material 47 in the form of finely-divided particles, and a binder agent 43*c*. The second ink layer 43*b* comprises a thermofusible material 49 in the form of finely-divided particles, preferably with an average particle size smaller than that of the particles of the thermofusible material 47 in the first ink layer 43*a*, a coloring agent 48, and the binder agent 43*c*.

In the above thermal image transfer recording medium, the first ink layer 43*a* is substantially the same as the first ink layer 33a in FIG. 5, and the formulation of the second ink layer 43b may be the same as that of the second ink layer 33b in FIG. 5, but as mentioned above, it is preferable that the average particle diameter of the finely-divided particles of the thermofusible material 49 in the second ink layer 43b be smaller than that of the finely-divided particles of the thermofusible material 47 in the first ink layer 43a.

More specifically it is preferable that the finely-divided particles of the thermofusible material 47 in the first ink layer 43 have an average particle diameter in the range of 0.50 to 3.00 μm, and that the finely-divided particles of the thermofusible material 49 contained in the second ink layer 43b have an average particle diameter be in the range of 0.15 to 0.35 μm.

The average particle diameter of the finely-divided particles of the thermofusible material for use in the present invention is calculated by measuring the particle diameters of the thermofusible material in a cross section of each ink layer by observing the cross section with a transmission-type electron microscope (TEM). The particle sizes of the thermofusible material observed by the TEM are approximately equal to the particles sizes of the thermofusible material dispersed in the first or second ink layer coating liquid. Therefore, the particles diameters of the thermofusible material in the ink layers can be appropriately adjustable at the stage of preparing the coating liquids for the first and second ink layer coating liquids. The particle size of the thermofusible material in such coating liquids can be easily measured by a laser scattering particle size distribution analyzer "LA-700" (Trademark) made by Horiba Ltd. in Japan.

Furthermore, it is preferable that 75 wt. % or more of the finely-divided particles of the thermofusible material 47 contained in the first ink layer 43a have particle diameters in the range of 0.5 to 3.0 μm to the entire weight of the thermofusible material in the first ink layer 43a to avoid the formation of voids in the printed images.

Probably for the following reasons, the above advantages can be obtained in the case where the particle diameters of the thermofusible material in each of the first ink layer 43a and the second ink layer 43b are within the previously mentioned respective ranges:

It is considered that when the average particle diameter of the finely-divided particles of the thermofusible material 49 in the second ink layer 43b is made smaller than that of the finely-divided particles of the thermofusible material 47 in the first ink layer 43a, and the average particle diameter of the finely-divided particles of the thermofusible material 47 in the first ink layer 43a is adjusted to be in the range of 0.50 to 3.00 μm, the flexibility of the ink layer 43 composed of the first ink layer 43a and the second ink layer 43b is increased, and the shearing strength of the ink layer 43 is decreased. Furthermore, in this case, it is considered that a crack is formed in the interface between (a) a printing portion in which the particles of the thermofusible material are fused with application of heat and (b) a non-printing portion in which the particles of the thermofusible material are individually present in the course of the printing process, so that clear-cut ink layer transfer is accomplished even with the application of a small amount of thermal energy.

Furthermore, it is considered that when the average particle diameter of the finely-divided particles of the thermofusible material 49 in the second ink layer 43b is made smaller than that of the finely-divided particles of the thermofusible material 47 in the first ink layer 43a, the thermofusible material 47 is more closely packed in the second ink layer 43b than that in the first ink layer 43a, so that the ink transfer to the image-receiving sheet can be carried out effectively because of the efficient fusing of the thermofusible material 47 when heat is applied thereto for image transfer.

Moreover it is considered that when the finely-divided particles of the thermofusible material particle diameters in the range of 0.5 to 3.0 μm are contained in the first ink layer 43a in an amount of 75 wt. % or more of the entire weight of the thermofusible material in the first ink layer 43a, the amount of the particles of the thermofusible material which form images with voids is significantly small, so that the formation of images with voids can be minimized.

By contrast, in the case where the particle diameters of the thermofusible material in each of the first ink layer 43a and the second ink layer 43b are outside the above-mentioned respective ranges, drawbacks such as the formation of voids in the images when high speed printing is conducted, or when an image-receiving sheet with a low smoothness is employed; the occurrence of imperfect image transfer; and the reduction of the thermosensitivity of the ink layers are inevitable.

The finely-divided particles of the thermofusible material for use in the present invention each comprise a thermofusible organic lubricant or wax component, which is hereinafter referred to as a wax component.

It is preferable that the wax component have a melting viscosity of 60 cps or less at 100° C. in order to improve the adhesiveness of the thermofusible particles to an image-receiving receiving sheet when fused with application of heat. When the melting viscosity of the wax component is more than 60 cps, satisfactory adhesiveness and adhesion strength cannot be obtained between the heated finely-divided particles of the thermofusible material during the printing process, so that the boundary between the heated portion for printing print and the non-heated portion for non-printing in the thermofusible ink layer cannot be clearly formed.

In addition to the above, in this case, the thermofusible ink layer does not exhibit satisfactory releasing performance in the heated portion to be transferred to an image-receiving sheet, and the adhesion strength of the transferred portion of the thermofusible ink layer is decreased. The result is that the thermo-sensitivity of the thermal image transfer recording medium is lowered, and images with voids tend to be formed when images are printed by use of a high speed printer or when images are printed on an image receiving sheet with low smoothness.

Specific examples of the wax component include natural waxes such as carnauba wax, candelilla wax, rice wax, castor wax, and montan wax; and amides such as 12-hydroxystearic acid derivatives, modified polyethylene, α-olefin, maleic anhydride derivatives, lanolin wax derivatives, and amides such as aliphatic amides and aromatic amides. In particular, it is preferable to employ carnauba wax as the wax component from the viewpoints of the hardness and the endothermic properties.

A thermoplastic resin can be mixed and fused with the above-mentioned wax component in the form of a solid solution for use as the main component of the particles of the above-mentioned thermofusible material. Examples of such a thermoplastic resin can be selected from a variety of resins with a melting point or a softening point of 70° to 140° C. such as acrylic resin, methacrylic resin, styrene resin, vinyl acetate resin, vinyl chloride resin, vinylidene chloride resin, petroleum resin, terpene resin, olefin resin, polyester resin, polyacetal resin and the copolymers thereof.

When the melting point or softening point of the thermoplastic resin is below 70° C., the image obtained by use of the thermal image transfer recording medium has poor frictional resistance at temperatures of 30° to 60° C., while when the melting point or softening point thereof is above 140° C., it is necessary to apply a large quantity of thermal energy to the recording medium in the course of thermal image transfer recording, so that there are problems in that the printing speed becomes slow and the durability of a thermal head is decreased.

As the binder agent for each ink layer, an unvulcanized rubber is preferably employed, imparts high binding properties and flexibility to each ink layer, even when a small amount of the unvulcanized rubber is used.

Examples of the unvulcanized rubber include polyisoprene, polybutadiene, styrene-butadiene rubber, nitrile rubber, ethylene propylene rubber, butyl rubber, silicone rubber, fluororubber, and urethane rubber.

It is preferable to employ polyisoprene, polybutadiene, ethylene propylene rubber, butyl rubber, and nitrile rubber. These rubbers have melting points in the range of 60° to 200° C.

In addition to the above, thermoplastic resins such as ethylene-vinyl acetate copolymer (EVA) can be appropriately employed. As a flexibilizer for each layer, various kinds of oils can be used in the present invention.

In the case where the first ink layer comprises the unvulcanized rubber and finely-divided particles of the thermofusible material, it is preferable that the amount ratio of the unvulcanized rubber to the thermofusible material be in the range of (3 to 30) to (97 to 70), more preferably in the range of (5 to 20) to (95 to 80).

In the case where the amount ratio of the unvulcanized rubber is 3% or less to the entire ink layer, a sufficient binding performance cannot be obtained, so that the ink layer tends to be peeled off the support, and the frictional resistance of the images obtained is decreased, while when the amount ratio of the unvulcanized rubber exceeds 30%, the surface of the obtained images loses lubricating performance, and the frictional resistance thereof deteriorates. Further, in this case, the releasing properties of the layers are lowered and the thermosensitivity of the recording material is decreased.

It is preferable that the thickness of the first ink layer be in the range of 0.5 to 5 μm, more preferably in the range of 1.0 to 2.5 μm, to obtain excellent image transfer performance even when an image receiving sheet with a low smoothness is used or when high speed printing is conducted.

The first ink layer can be formed by coating an organic solvent dispersion, an aqueous dispersion, or an emulsion to the support. Of these, a method of using an emulsion is preferable to prepare stable finely-divided particles of thermofusible material.

The second ink layer for use in the present invention comprises as the main components a coloring agent and a wax component as mentioned previously. When necessary, a resin with a low melting point can be added to the second ink layer.

The coloring agent can be appropriately selected from the conventional dyes and pigments.

Examples of the wax component are the same as previously described.

The thermofusible material for use in the second ink layer may also comprise a resin component with a low melting point. Examples of such a resin component are polyamide-based resin, polyester-based resin, polyurethane-based resin, vinyl chloride-based resin, cellulose-based resin, petroleum-based resin, styrene-based resin, butyral-based resin, phenolic resin, ethylene-vinyl acetate copolymer, ethylene-acrylic resin, and terpene resin.

It is preferable that the ratio by weight of the coloring agent/the wax component/the resin component be in the range of 5–50/30–90/5–50.

The second ink layer can also be formed by coating a organic solvent solution, an aqueous dispersion, or an emulsion to the support or by the hot-melt coating method. It is also preferable to employ an emulsion of finely-divided particles of the thermofusible material for the formation of the second ink layer.

It is generally preferable that the thickness of the second ink layer be in the range of 0.5 to 5.0 μm, more preferably in the range of 1.0 to 2.5 μm, in order to obtain images with high quality, free from voids and improper image transfer, even when images with low density are to be obtained or images are transferred to an image-receiving sheet with low smoothness, or when the thermal image transfer recording medium is used for high speed printing with the application of low thermal energy.

Furthermore, in addition to the previously described components to be contained in the first ink layer and the second ink layer, the following materials can be added in an amount of 30% or less: plastisizers such as fatty acid esters, glycol esters, phosphoric esters, and epoxidized linseed oil; flexibilizer such as mineral oil, animal oil, vegetable oil, and silicone oil. Further, a coloring agent may be added to the first ink layer in an amount up to 8 wt. % of the entire weight of the first ink layer.

As materials for the support for supporting the above mentioned first and second ink layers, heat-resistant plastic films such as polyester, polycarbonate, triacetyl cellulose, polyamide, and polyimide; cellophane; parchment paper; and condenser paper can be employed.

If necessary, a heat-resistant layer may be formed on the back side of the support, with which side a thermal head comes into contact. Examples of the material used for the heat-resistant layer include silicone resin, fluorocarbon resin, polyimide resin, epoxy resin, phenolic resin, melamine resin, and cellulose-based resin.

An intermediate may be interposed between the first ink layer and the support to improve the adhesion of the first ink layer to the support.

The features of this invention will become apparent in the course of the following description of exemplary embodiments, which are given for illustration of the invention and are not intended to be limiting thereof.

EXAMPLE 1—1

Preparation of Thermofusible Ink Layer

The following components were mixed to prepare an ink layer coating liquid:

| | Parts by Weight |
|---|---|
| Aqueous dispersion of carnauba wax (solid component: 30%) | 255 |
| Aqueous dispersion of Candelilla wax (solid component: 30%) | 28 |
| Aqueous dispersion of polybutadiene rubber latex (Trademark "JSR #0700" made by Japan Synthetic Rubber Co., Ltd. solid component: 50%) | 10 |
| Aqueous dispersion of carbon black (solid component: 20%) | 50 |
| Nonionic surface active agent Trademark "Rheodol TW-S120", made by Kao Corporation) | 1 |
| Water | 136 |
| Methanol | 20 |

The above prepared ink layer coating liquid was coated on a polyethylene telepthalate (PET) film with a thickness of about 4.5 μm, serving as a support, using a wire bar and dried at a temperature of 60° C., so that a thermofusible ink layer with a thickness of about 3.5 μm was formed on the support, whereby a thermal image transfer recording medium No. 1—1 according to the present invention was prepared.

EXAMPLE 1-2

Preparation of First Ink Layer

The following components were mixed to prepare a first ink layer coating liquid:

| | Parts by Weight |
|---|---|
| Aqueous dispersion of carnauba wax (solid component: 30%) | 276 |
| Aqueous dispersion of Candelilla wax solid component: 30%) | 30 |
| Aqueous dispersion of carboxy-modified acrylonitrile butadiene rubber latex (Trademark "JSR-0910", made by Japan Synthetic Rubber Co., Ltd, (solid component: 40%) | 20 |
| Water | 154 |
| Methanol | 20 |

The above prepared first ink layer coating liquid was coated on a polyethylene telepthalate (PET) film with a thickness of about 4.5 μm, serving as a support, using a wire bar and dried at a temperature of 60° C., so that a first ink layer with a thickness of about 1.5 μm was formed on the support.

Preparation of Second Ink Layer

The following components were mixed to prepare a second ink layer coating liquid:

| | Parts by Weight |
|---|---|
| Aqueous dispersion of carnauba wax (solid component: 30%) | 183 |
| Aqueous dispersion of candelilla wax solid component: 30%) | 67 |
| Aqueous dispersion of ethylene-vinyl acetate copolymer (solid component: 30%) | 33 |
| Aqueous dispersion of carbon black solid component: 20%) | 75 |
| Nonionic surface active agent (Trademark "Rheodol TW-S120", made by Kao Corporation) | 1 |
| Water | 61 |
| Methanol | 80 |

The above prepared second ink layer coating liquid was coated on the first ink layer, using a wire bar and dried, so that a second ink layer with a thickness of 1.5 μm was formed on the first ink layer, whereby a thermal image transfer recording medium No. 1-2 according to the present invention was prepared.

EXAMPLE 1-3

The procedure for preparation of the thermal image transfer recording medium in Example 1-2 was repeated except that the first ink layer coating liquid employed in Example 1-2 was replaced with a first ink layer coating liquid with the following formulation, whereby a thermal image transfer recording medium No. 1-3 according to the present invention was prepared:

| | Parts by Weight |
|---|---|
| Aqueous dispersion of a mixed wax of carnauba wax and paraffin wax (mixing ratio: (95:5), Trademark "HNP-16" made by Nippon Seiro Co., Ltd., solid component: 30%) | 313 |
| Aqueous dispersion of carboxy-modified styrene-butadiene rubber latex (Trademark "JSR 0561", made by Japan Synthetic Rubber Co., Ltd., solid component: 60%) | 10 |
| Water | 157 |
| Methanol | 20 |

EXAMPLE 1-4

The procedure for preparation of the thermal image transfer recording medium in Example 1-2 was repeated except that the first ink layer coating liquid employed in Example 1-2 was replaced with a first ink layer coating liquid with the following formulation, whereby a thermal image transfer recording medium No. 1-4 according to the present invention was prepared:

| | Parts by Weight |
|---|---|
| Aqueous dispersion of a mixed wax of carnauba wax and montan wax (mixing ratio: (90:10), Trademark "Hoechst-Wax KP" made by Hoechst Japan Limited, solid component: 30%) | 30 |
| Aqueous dispersion of styrene-butadiene rubber latex (Trademark "JSR Roadex", made by Japan Synthetic Rubber Co., Ltd., solid component: 50%) | 16 |
| Water | 157 |
| Methanol | 20 |

COMPARATIVE EXAMPLE 1—1

The procedure for preparation of the thermal image transfer recording medium in Example 1-2 was repeated except that the first ink layer coating liquid employed in Example 1-2 was replaced with a comparative first ink layer coating liquid with the following formulation, whereby a comparative thermal image transfer recording medium No. 1—1 was prepared:

| | Parts by Weight |
|---|---|
| Carnauba wax | 81 |
| Candelilla wax | 9 |
| Polybutadiene rubber (Trademark "JSR BR 31", made by Japan Synthetic Rubber Co., Ltd.) | 5 |
| Ethylene-vinyl acetate copolymer (Trademark "EVA Flex 210", made by Du Pont-Mitsui Polychemicals Co., Ltd.) | 5 |
| Toluene | 900 |

COMPARATIVE EXAMPLE 1-2

The procedure for preparation of the thermal image transfer recording medium in Example 1-2 was repeated except that the first ink layer coating liquid employed in Example 1-2 was replaced with a comparative first ink layer coating liquid with the following formulation, whereby a comparative thermal image transfer recording medium No. 1-2 was prepared:

| | Parts by Weight |
|---|---|
| Carnauba wax | 81 |
| Candelilla wax | 9 |
| Polybutadiene rubber (Trademark "JSR BR 31", made by Japan Synthetic Rubber Co., Ltd.) | 5 |
| Styrene-butadiene rubber (Trademark "JSR 1712", made by Japan Synthetic Rubber Co., Ltd.) | 5 |
| Toluene | 900 |

COMPARATIVE EXAMPLE 1-3

The procedure for preparation of the thermal image transfer recording medium in Example 1-2 was repeated except that the first ink layer coating liquid employed in Example 1-2 was replaced with a comparative first ink layer coating liquid with the following formulation, whereby a comparative thermal image transfer recording medium No. 1-3 was prepared:

| | Parts by Weight |
|---|---|
| Aqueous dispersion of paraffin wax (Trademark "HNP-16", made by Nippon Seiro Co., Ltd.) | 313 |
| Aqueous dispersion of carboxy-modified styrene butadiene rubber latex (Trademark "JSR 0561", made by Japan Synthetic Rubber Co., Ltd., solid component: 60%) | 10 |
| Water | 157 |
| Methanol | 20 |

With respect to each of the thermal image transfer recording media No. 1—1 to No. 1-4 prepared in Examples 1—1 to 1-4 according to the present invention and the comparative image transfer recording media No. 1—1 to No. 1-3 prepared in Comparative Examples 1—1 to 1-3, the shearing strength and adhesion strength of each thermofusible ink layer, the loaded needle penetration of the thermofusible material employed in each thermofusible ink layer, and the occurrence of the coming off of the ink layer from the support were investigated. The results are shown in the following Table 1.

Each of these thermal image transfer recording media was then subjected to an image transfer test by use of a high quality paper with a smoothness of about 70 sec in terms of Bekk's smoothness (made by FSK Co., Ltd.) and a thermal image transfer printer for bar code formation (Trademark "SWEDOT 196", made by Atech Co., Ltd.) with the application of a standard amount of thermal energy at 20° C., 60% RH. Thus, bar codes were printed on the high quality paper, and the readable ratio of each bar code was investigated by use of a commercially available bar code reader (Trademark "Laser Check LC-2811", made by Symbol Technologies, Inc.). The quality of the printed bar code was evaluated by scanning a laser beam over each bar code 100 times by the bar code reader and then counting the accurately read percentage. Thus, a bar code with the read percentage being 100 could be evaluated as the printed quality thereof being perfect. The results are shown in the Table 1.

Furthermore, the bar code images printed by the above thermal image transfer recording media were subjected to a frictional resistance test by using test samples which were obtained by printing bar codes by each of the thermal image transfer recording media on a mirror coat paper (made by Kanzaki Paper Manufacturing Co., Ltd.), whose surface was treated so as to have a smoothness of about 4000 sec in terms of Bekk's smoothness. Each of the thus printed bar code images was rubbed at an identical portion 50 times by a corrugated board with a size of 4 cm×7 cm with the application of a load of 1 kgf by use of a rub tester. The results are also shown in Table 1.

TABLE 1

| | Shearing Strength (g/cm) | Adhesion Strength (g/cm) | Loaded Needle penetration at 25° C. | Occurrence of Coming Off of Ink Layer | Bar Code Read Ratio (%) | Bar Code Read Ratio after Frictional Resistance Test (%) |
|---|---|---|---|---|---|---|
| Ex. 1-1 | 15 | 1.5 | 1 | none | 100 | 100 |
| Ex. 1-2 | 13 | 1.4 | 1 | none | 100 | 100 |
| Ex. 1-3 | 16 | 1.3 | 1.5 | none | 100 | 100 |
| Ex. 1-4 | 16 | 1.4 | 1.5 | none | 100 | 100 |
| Comp. Ex. 1-1 | 165 | 1.7 | 1 | observed | 20 | 100 |
| Comp. Ex. 1-2 | 145 | 2.8 | 1 | none | 10 | 100 |
| Comp. Ex. 1-3 | 17 | 1.5 | 6 | none | 50 | 30 |

EXAMPLE 2-1

Preparation of First Ink Layer

The following components were mixed to prepare a first ink layer coating liquid:

| | Parts by Weight |
|---|---|
| Aqueous dispersion of carnauba wax (solid component: 30%, average particle diameter: 1.2 μm) | 150 |
| Aqueous dispersion of butadiene rubber (solid component: 50%) | 10 |
| Water | 90 |

The above prepared first ink layer coating liquid was coated on a polyethylene telepthalate (PET) film with a thickness of 4.5 μm, serving as a support, using a wire bar and dried by being exposed to warm air at 60° C., so that a first ink layer with a thickness of about 1.8 μm was formed on the support.

The void of the above prepared first ink layer was calculated to be 18.4 vol. % from the thickness of the first ink layer and the basis weight thereof.

Preparation of Second Ink Layer

The following components were mixed to prepare a second ink layer coating liquid:

| | Parts by Weight |
|---|---|
| Aqueous dispersion of carnauba wax (solid component: 30%, average particle diameter: 0.29 μm) | 183 |
| Aqueous dispersion of candelilla wax (solid component: 30%, average particle diameter: 0.18 μm) | 67 |
| Aqueous dispersion of ethylene-vinyl acetate copolymer solid component: 30%) | 33 |
| Aqueous dispersion of carbon black (solid component: 20%) | 75 |
| Nonionic surface active agent (Trademark "Rheodol TW-S120, made by Kao Corporation) | 1 |
| Water | 61 |
| Methanol | 80 |

The above prepared second ink layer coating liquid was coated on the first ink layer, using a wire bar and dried, so that a second ink layer with a thickness of 1.2 μm was formed, whereby a thermal image transfer recording medium No. 2-1 according to the present invention was prepared.

Figure 7:
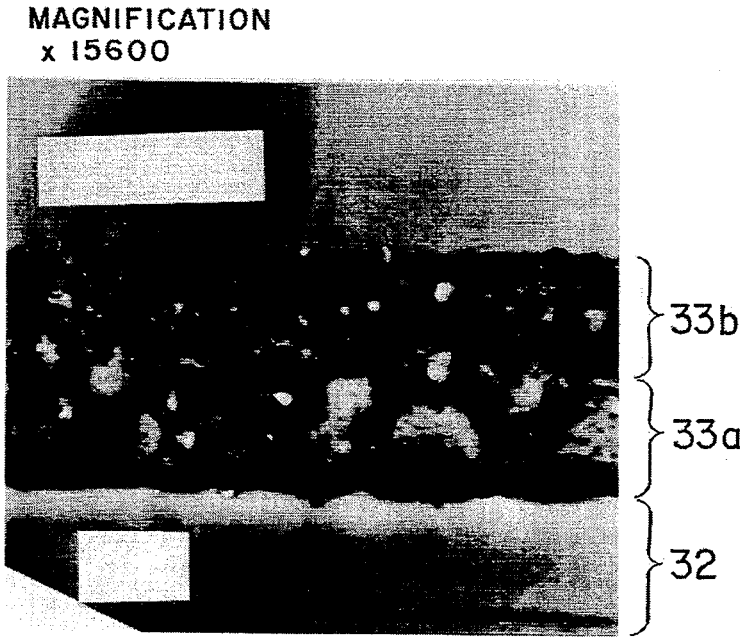
FIG. 7 is a TEM photograph of a cross section the thermal image transfer recording medium prepared in Example 2-1.

A TEM photograph of a cross sectional view of the above obtained thermal transfer recording medium is shown in FIG. 7. In the TEM photograph, reference numeral 32 indicates the PET film; reference numeral 32*a*, the first ink layer; and reference numeral 32*b*, the second ink layer.

EXAMPLE 2—2

The procedure for preparation of the thermal image transfer recording medium in Example 2-1 was repeated except that the first ink layer coating liquid employed in Example 2-1 was replaced by a first ink layer coating liquid with a following formulation, whereby a thermal image transfer recording medium No. 2—2 according to the present invention was prepared.

| | Parts by Weight |
|---|---|
| Aqueous dispersion of a mixed wax of carnauba wax and candelilla (mixing ratio: (7:3), solid component: 30%, average particle diameter: 0.9 μm) | 155 |
| Aqueous dispersion of styrene-butadiene rubber (solid component: 50%) | 7 |
| Water | 88 |

The voidage of the first ink layer was 12.0 vol. %.

EXAMPLE 2-3

The procedure for preparation of the thermal image transfer recording medium in Example 2-1 was repeated except that the first ink layer coating liquid employed in Example 2-1 was replaced by a first ink layer coating liquid with the following formulation, whereby a thermal image transfer recording medium No. 2-3 according to the present invention was prepared:

| | Parts by Weight |
|---|---|
| Aqueous dispersion of a mixed wax of carnauba wax and synthesized lanolin derivative wax (mixing ratio of: (9:1), solid component: 30%, average particle diameter: 1.5 μm) | 155 |
| Aqueous dispersion of carboxy-modified acrylonitrile butadiene (solid component: 50%) | 10 |
| Water | 85 |

The voidage of the first ink layer was 15.5 vol. %.

COMPARATIVE EXAMPLE 2-1

The procedure for preparation of the thermal image transfer recording medium in Example 2-1 was repeated except that the coated first ink layer coating liquid was dried by being exposed to hot air at a temperature of 85° C., whereby a comparative thermal image transfer recording medium No. 2-1 was prepared.

The voidage of the first ink layer was 0%.

COMPARATIVE EXAMPLE 2—2

The procedure for preparation of the thermal image transfer recording medium in Example 2-1 was repeated except that the first ink layer coating liquid employed in Example 2-1 was replaced by a first ink layer coating liquid with the following formulation, whereby a comparative thermal image transfer recording medium No. 2—2 was prepared:

| | Parts by Weight |
|---|---|
| Aqueous dispersion of carnauba wax (solid component: 30%, average particle diameter: 3.5 μm) | 150 |
| Aqueous dispersion of butadiene rubber (solid component: 50%) | 10 |
| Water | 90 |

The voidage of the first ink layer was 32.0 vol. %.

COMPARATIVE EXAMPLE 2-3

The procedure for preparation of the thermal image transfer recording material in Example 2-1 was repeated except that the first ink layer coating liquid employed in Example 2-1 was replaced by a first ink layer coating liquid with the following formulation, whereby a comparative thermal image transfer recording medium No. 2–3 was prepared:

| | Parts by Weight |
|---|---|
| Paraffin wax (melting point: 70° C., solid component: 30%, average particle diameter: 0.8 μm, needle penetration: 6) | 155 |
| Aqueous dispersion of styrene-butadiene rubber (solid component: 50%) | 7 |
| Water | 88 |

The voidage of the first ink layer was 11.0 vol. %.

Each of the thermal image transfer recording media No. 2-1 to No. 2–3 prepared respectively in Examples 2-1 to 2–3 according to the present invention, and comparative thermal image transfer recording media No. 2-1 to No. 2–3 respectively prepared in Comparative Examples 2-1 to 2–3 was then subjected to an image transfer test by use of a high quality paper with a smoothness of about 70 sec in terms of Bekk's smoothness (made by FSK Co., Ltd.) and a thermal image transfer printer for bar code formation (Trademark "SWEDOT 196", made by Atech Co., Ltd.) with the application of a standard amount of thermal energy at 20° C., 60% RH. Thus, bar codes were printed on the high quality paper, and the readable ratio of each bar code was investigated by use of a commercially available bar code reader (Trademark "Laser Check LC-2811", made by Symbol Technologies, Inc.). The quality of the printed bar code was evaluated by scanning a laser beam over each bar code 100 times by the bar code reader and then counting the accurately read percentage. Thus, a bar code with the read percentage being 100 could be evaluated as the printed quality thereof being perfect. The results are shown in the Table 2.

Furthermore, the bar code images printed by the above thermal image transfer recording media were subjected to a frictional resistance test by using test samples which were obtained by printing bar codes by each of the thermal image transfer recording media on a mirror coat paper (made by Kanzaki Paper Manufacturing Co., Ltd.), whose surface was treated so as to have a smoothness of about 4000 sec in terms of Bekk's smoothness. Each of the thus printed bar code images was rubbed at an identical portion 50 times by a corrugated board with a size of 4 cm×7 cm with the application of a load of 1 kgf by use of a rub tester. The results are also shown in Table 2.

TABLE 2

| | Voidage (%) | Average Particle Diameter of Wax in First Ink Layer (μm) | Loaded Needle Penetration of Wax in First Ink Layer at 25° C. | Image Transfer Performance on High Quality Paper | Bar code Read Ratio (%) | Frictional Resistance |
|---|---|---|---|---|---|---|
| Ex. 2-1 | 18.4 | 1.2 | 1 or less | o | 100 | o |
| Ex. 2-2 | 12.0 | 0.9 | 1 | o | 100 | o |
| Ex. 2-3 | 15.5 | 1.5 | 1.5 | o | 100 | o |
| Comp. Ex. 2-1 | 0 | — | 1 or less | x | 23 | o |
| Comp. Ex. 2-2 | 32.0 | 2.1 | 1 or less | x | 35 | o |
| Comp. Ex. 2-3 | 11.0 | 0.8 | 6 | o | 84 | x |

In Table 2, the marks o, and x, indicating the evaluation results of the image transfer performance and the frictional resistance respectively denote as follows:

Image transfer performance:

o . . . Bar code images are clearly transferred.

x . . . Bar code images are not clearly printed, and partially not transferred. Frictional resistance (corrugated board test):

o . . . Bar code portion can be read by a bar code scanner with substantially no background smearing.

x . . . Bar code portion is smeared and difficult to read by a bar code scanner.

EXAMPLE 2–4

Preparation of Carnauba Wax Emulsion No. 1

A mixture of the following components was fused at 90° C.:

| | Parts by Weight |
|---|---|
| Carnauba wax | 27 |
| Nonionic emulsifier "HLB 14" (Trademark), made by K. K. Konishi) | 3.0 |

To the above mixture, 70.0 parts by weight of boiling water were added with stirring, and pre-emulsified in a disperser. The mixture was then emulsified in a high-pressure homogenizer and rapidly cooled with water, whereby a carnauba wax emulsion No. 1 was prepared.

The average particle diameter of the carnauba wax was 1.25 μm.

Carnauba Wax Emulsion No. 2

A mixture of the following components was fused at 90° C.:

| | Parts by Weight |
|---|---|
| Carnauba wax | 27 |
| Anionic emulsifier ("HLB 13" (Trademark), made by K. K. Konishi) | 3.0 |

To the above mixture, 70.0 parts by weight of boiling water were added with stirring. The mixture was thoroughly pre-emulsified in a disperser. The mixture was then emulsified in a high-pressure homogenizer, rapidly cooled with water, whereby a carnauba wax emulsion No. 2 was prepared.

The average particle diameter of the carnauba wax was 0.224 μm.

Preparation of First Ink Layer

The following components were mixed to prepare a first ink layer coating liquid:

| | Parts by Weight |
|---|---|
| Carnauba wax emulsion No. 1 (solid component: 30%, average particle diameter: 1.25 μm) | 150 |
| Butadiene rubber latex (Trademark "JSR #0700", made by Japan Synthetic Rubber Co., Ltd., solid component: 50%) | 10 |
| Water | 90 |

The above prepared first ink layer coating liquid was coated on a polyethylene telepthalate (PET) film with a thickness of 4.5 μm, serving as a support, using a wire bar and dried by being exposed to warm air at 60° C., so that a first ink layer with a thickness of about 1.5 μm was formed on the support.

Preparation of Second Ink Layer

The following components were mixed to prepare a second ink layer coating liquid:

| | Parts by Weight |
|---|---|
| Carnauba wax emulsion No. 2 (solid component: 30%, average particle diameter: 0.224 μm) | 250 |
| Ethylene-vinyl acetate copolymer latex (Trademark "Sumikaflex 410", made by Sumitomo Chemical Co., Ltd., solid component: 30%) | 33 |
| Aqueous dispersion of carbon black (solid component: 20%) | 75 |
| Nonionic surface active agent (Trademark "Rheodol TW-S120", made by Kao Corporation) | 1 |
| Water | 61 |
| Methanol | 80 |

The above prepared second ink layer coating liquid was coated on the first ink layer, using a wire bar and dried at 70° C., so that a second ink layer with a thickness of about 1.4 μm was formed on the first ink layer, whereby a thermal image transfer recording medium No. 2-4 according to the present invention was prepared.

Figure 8:
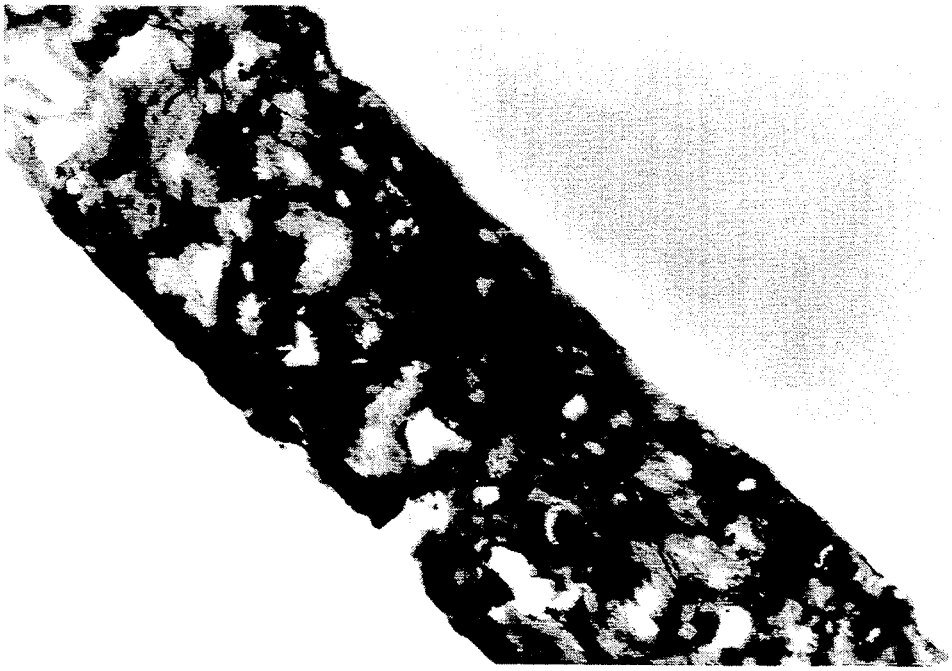
FIG. 8 is a TEM photograph of a cross section which shows the particle structure of a thermal image transfer recording medium prepared in Example 2–4.

A TEM photograph of a cross-sectional view of the above obtained thermal image transfer recording medium is shown in FIG. 8.

EXAMPLE 2-5

The procedure for preparation of the thermal image transfer recording medium in Example 2-4 was repeated except that the first ink layer coating liquid employed in Example 2-4 was replaced by a first ink layer coating liquid with the following formulation, whereby a thermal image transfer recording medium No. 2-5 according to the present invention was prepared:

| | Parts by Weight |
|---|---|
| Emulsion of carnauba wax and candelilla wax (mixing ratio: (7:3), solid component: 30%, average particle diameter: 1.95 μm) prepared in the same manner as Carnauba Wax Emulsion No. 1 in Example 2-4 | 155 |
| Styrene-butadiene rubber latex (Trademark "JSR 0561", made by Japan Synthetic Rubber Co., Ltd., solid component: 50%) | 7 |
| Water | 88 |

EXAMPLE 2-6

The procedure for preparation of the thermal image transfer recording medium in Example 2-4 was repeated except that the first ink layer coating liquid employed in Example 2-4 was replaced by a first ink layer coating liquid with the following formulation, whereby a thermal image transfer recording medium No. 2-6 according to the present invention was prepared:

| | Parts by Weight |
|---|---|
| Emulsion of carnauba wax and synthesized lanolin derivative wax (mixing ratio: (9:1), solid component: 30%, average particle diameter: 2.10 μm) prepared in the same manner as Carnauba Wax Emulsion No. 1 in Example 2-4 | 155 |
| Carboxy-modified acrylonitrile-butadiene latex (Trademark "JSR 0910", made by Japan Synthetic Rubber Co., Ltd., solid component: 50%) | 10 |
| Water | 85 |

EXAMPLE 2-7

The procedure for preparation of the thermal image transfer recording medium in Example 2-4 was repeated except that the second ink layer coating liquid employed in Example 2-4 was replaced in by a second ink layer coating liquid with the following formulation, whereby a thermal image transfer recording medium No. 2-7 according to the present invention was prepared:

| | Parts by Weight |
|---|---|
| Emulsion of carnauba wax (solid component: 30%, average particle diameter: 0.29 μm) prepared in the same manner as Carnauba Wax Emulsion No. 2 in Example 2-4 | 183 |
| Emulsion of candelilla wax solid component: 30%, average particle diameter: 0.18 μm) prepared in the same manner as Carnauba Wax Emulsion No. 2 in Example 2-4 | 67 |
| Ethylene-vinyl acetate copolymer latex (Trademark "Sumikaflex 401" made by Sumitomo Chemical Co., Ltd., solid component: 30%) | 33 |
| Aqueous dispersion of carbon black (solid component: 20%) | 75 |
| Nonionic surface active agent (Trademark "Rheodol TW-S120", made by Kao Corporation) | 1 |

-continued

| | Parts by Weight |
|---|---|
| Water | 61 |
| Methanol | 80 |

EXAMPLE 2-8

The procedure for preparation of the thermal image transfer recording medium in Example 2-5 was repeated except that the second ink layer coating liquid employed in Example 2-5 was replaced by a second ink layer coating liquid with the following formulation, whereby a thermal image transfer recording medium No. 2-8 according to the present invention was prepared:

| | Parts by Weight |
|---|---|
| Emulsion of carnauba wax and terpene resin (mixing ratio by weight: (90:10), solid component: 30%, average particle diameter: 0.32 μm) | 250 |
| Aqueous dispersion of carbon black (solid component: 20%) | 75 |
| Nonionic surface active agent (Trademark "Rheodol TW-S120", made by Kao Corporation) | 1 |
| Oil (Trademark "polypropylene glycol #1000", made by Mobil Sekiyu K. K.) | 10 |
| Water | 84 |
| Methanol | 80 |

EXAMPLE 2-9

The procedure for preparation of the thermal image transfer recording medium in Example 2-4 was repeated except that the formulation of the second ink layer coating liquid employed in Example 2-4 was changed as follows and the obtained second ink layer coating liquid was coated on the first ink layer by a hot melt coating method to obtain a second ink layer with a thickness of 1.5 μm:

| | Parts by Weight |
|---|---|
| Carnauba wax | 70 |
| Ethylene-vinyl acetate copolymer (Trademark "Sumitate KE-10" made by Sumitomo Chemical Co., Ltd.) | 10 |
| Carbon black Trademark "MA-7" made by Mitsubishi Carbon Co., Ltd.) | 15 |
| Mineral oil | 5 |

Thus, a thermal image transfer recording medium No. 2-9 according to the present invention was prepared.

EXAMPLE 2-10

The procedure for preparation of the thermal image transfer recording medium in Example 2-4 was repeated except that the formulation of the second ink layer coating liquid employed in Example 2-4 was changed as follows and the obtained second ink layer coating liquid was coated on the first ink layer to obtain a second ink layer with a thickness of 1.4 μm:

| | Parts by Weight |
|---|---|
| Emulsion of carnauba wax (solid component: 30%, average particle diameter: 0.71 μm) prepared in the same manner as Carnauba Wax Emulsion No. 2 in Example 2-4 | 250 |
| Ethylene-vinyl acetate copolymer latex (Trademark "Sumikaflex 410", made by Sumitomo Chemical Co., Ltd., solid component: 30%) | 33 |
| Aqueous dispersion of carbon black solid component: 20%) | 75 |
| Nonionic surface active agent (Trademark "Rheodol TW-S120", made by Kao Corporation, main component) | 1 |
| Water | 61 |
| Methanol | 80 |

Thus, a thermal image transfer recording medium No. 2-10 according to the present invention was prepared.

COMPARATIVE EXAMPLE 2-4

The procedure for preparation of the thermal image transfer recording medium in Example 2-4 was repeated except that the first ink layer was dried by a hot air at 85° C., whereby a comparative thermal image transfer recording medium No. 2-4 was prepared.

The first ink layer of the above obtained comparative thermal image transfer recording medium appeared semi-transparent state, because the finely-divided particles of the thermofusible material contained in the first ink layer were fused.

COMPARATIVE EXAMPLE 2-5

The procedure for preparation of the thermal image transfer recording medium in Example 2-4 was repeated except the first ink layer coating liquid employed in Example 2-4 was replaced by a first ink layer with the following formulation, whereby a comparative thermal image transfer recording medium No. 2-5 was prepared:

| | Parts by Weight |
|---|---|
| Carnauba wax emulsion (solid component: 30%, average particle diameter: 4.6 μm) | 150 |
| Butadiene rubber latex (Trademark "JSR #0700", made by Japan Synthetic Rubber Co., Ltd., solid component: 50%) | 10 |
| Water | 90 |

COMPARATIVE EXAMPLE 2-6

The procedure for preparation of the thermal image transfer recording medium in Example 2-4 was repeated except that the formulation of the first ink layer coating liquid employed in Example 2-4 was changed as follows and the thus obtained first ink layer coating liquid was coated on the PET film by a hot melt coating method to obtain a first ink layer with a thickness of 3.0 μm, whereby a comparative thermal image transfer recording medium No. 2-6 was prepared:

| | Parts by Weight |
|---|---|
| Carnauba wax | 40 |
| Paraffin wax | 32 |
| Carbon black | 15 |
| Mineral oil | 3 |
| Ethylene-vinyl acetate copolymer (Trademark "Sumitate KE-10", made by Sumitomo Chemical Co., Ltd.) | 10 |

EXAMPLE 2-11

The procedure for preparation of the thermal image transfer recording medium in Example 2-4 was repeated except that the carnauba wax with the particle diameters of 0.5 to 3.0 μm occupied 53.4% of the entire carnauba wax in the carnauba wax emulsion in the first ink layer coating liquid employed in Example 2-4.

Thus, a thermal image transfer recording medium No. 2-11 according to the present invention was prepared.

Each of the thermal image transfer recording media No. 2-4 to No. 2-11 respectively prepared in Examples 2-4 to 2-11 and comparative thermal image transfer recording media No. 2-4 to No. 2-6 respectively prepared in Comparative Examples 2-4 to 2-6 was subjected to an image transfer test on a regenerated paper (Trademark "Shigen", made by Ricoh Company, Ltd.) with a smoothness of about 50 sec in terms of Bekk's smoothness, and on a light-weight coat paper (Trademark "New Age 70", made by Kanzaki Paper Manufacturing Co., Ltd.) with a smoothness of about 400 sec in terms of Bekk's smoothness, by use of a thermal image transfer printer for bar code images "SWEDOT 196" (Trademark), made by Atech Co., Ltd. with the application of a standard amount of thermal energy at 60% RH, 20° C.

The image transfer performance, bar code read ratio, and the frictional resistance of each of these thermal image transfer recording media were evaluated in the same manner as mentioned previously. The results are shown in Table 3.

TABLE 3

| | Image Transfer Performance | | Bar Code Read Ratio (%) | | Frictional |
|---|---|---|---|---|---|
| | Regenerated Paper | New Age 70 | Regenerated Paper | New Age 70 | Resistance (Corrugated Board Test) |
| Ex. 2-4 | o | o | 92 | 100 | o |
| Ex. 2-5 | o | o | 98 | 100 | o |
| Ex. 2-6 | Δ | o | 95 | 100 | o |
| Ex. 2-7 | Δ | o | 98 | 100 | o |
| Ex. 2-8 | o | o | 99 | 100 | o |
| Ex. 2-9 | Δ | o | 77 | 100 | o |
| Ex. 2-10 | Δ | o | 84 | 100 | o |
| Ex. 2-11 | o | o | 86 | 96 | o |
| Comp. Ex. 2-4 | x | x | 0 | 36 | o |
| Comp. Ex. 2-5 | x | x | 0 | 42 | Δ |
| Comp. Ex. 2-6 | x | x | 0 | 0 | x |

In Table 3, the marks, o, and x indicating the evaluation results of the image transfer performance and the frictional resistance respectively denote as follows:

Image transfer performance:

o . . . Bar code images are clearly transferred.

Δ . . . Bar code images are less clearly tranferred than "o", but acceptable.

x . . . Bar code images are not clearly printed, and partially not transferred. Frictional resistance (corrugated board test):

o . . . Bar code portion can be completely read by a bar code scanner with substantially no background smearing.

Δ . . . Bar code portion can be read by a bar code scanner although there is a slight background smearing.

x . . . Bar code portion is smeared and difficult to read by a bar code scanner.

What is claimed is:

1. A thermal image transfer recording medium comprising a support, and a thermofusible ink layer having a thickness of 1 to 10 μm formed on said support, said thermofusible ink layer comprising a thermofusible material with a loaded needle penetration of 2 or less at 25° C., and a coloring agent, said thermofusible ink layer having a shearing strength of 8 to 20 gf/cm at 20° C., and an adhesion strength of 1.0 to 2.0 gf/cm with respect to said support.

2. The thermal image transfer recording medium as claimed in claim 1, wherein said thermofusible ink layer comprises a first ink layer having a thickness of 0.5 to 10 μm comprising said thermofusible material formed on said support and a second ink layer having a thickness of 1.5 to 3 μm comprising said thermofusible material and said coloring agent formed on said first ink layer.

3. The thermal image transfer recording medium as claimed in claim 1, wherein said thermofusible material is in the form of finely-divided thermofusible particles.

4. The thermal image transfer recording medium as claimed in claim 2, wherein said thermofusible material at least in said first ink layer is in the form of finely-divided thermofusible particles.

5. The thermal image transfer recording medium as claimed in claim 1, further comprising a heat resistant protective layer on the back side of said support opposite to said thermofusible ink layer.

6. The thermal image transfer recording medium as claimed in claim 1, wherein said thermofusible material comprises a wax component.

7. The thermal image transfer recording medium as claimed in claim 6, wherein said thermofusible material further comprises a resin component.

8. The thermal image transfer recording medium as claimed in claim 1, wherein said thermofusible material comprises a wax component and a resin component.

9. The thermal image transfer recording medium as claimed in claim 6, wherein said wax component is selected from the group consisting of paraffin wax, microcystalline wax, oxidized paraffin wax, candelilla wax, carnauba wax, montan wax, cersine wax, polyethylene wax, oxidized polyethylene wax, castor wax, beef tallow hardened oil, lanolin, Japan wax, sorbitan stearate, sorbitan palmitate, stearyl alcohol, polyamide wax, oleylamide wax, stearylamide, hydroxystearic acid, synthesized ester wax and synthesized lanolin derivative wax.

10. The thermal image transfer recording medium as claimed in claim 7, wherein said resin component is selected from the group consisting of rubber elastomer, polyamide-based resin, polyester-based resin, polyurethane-based resin, vinyl chloride-based resin, cellulose-based resin, petroleum-based resin, styrene-based resin, butyral-based resin, phenolic resin, ethylene-vinyl acetate copolymer, ethylene-acrylic resin, and terpene resin.

11. The thermal image transfer recording medium as claimed in claim 8, wherein the amount ratio by weight of said coloring agent, said wax component and said resin component in said thermofusible material is in the range of 5–50/30–90/5–50.

12. A thermal image transfer recording medium comprising a support and a first ink layer having a thickness of 0.5 to 10 μm formed on said support, comprising finely-divided particles of a thermofusible material with a loaded needle penetration of 2 or less at 25° C. and an average particle diameter in the range of 0.5 to 3.0 μm, said first ink layer having a voidage of 5 to 30 vol. %, and a second ink layer having a thickness of 1.5 to 3 μm formed on said first ink layer comprising a thermofusible material with a loaded needle penetration of 2 or less at 25° C. and a coloring agent.

13. The thermal image transfer recording medium as claimed in claim 12, wherein said thermofusible material in said second ink layer is in the form of finely-divided particles.

14. The thermal image transfer recording medium as claimed in claim 13, wherein the average particle diameter of said finely-divided particles of said thermofusible material in said second ink layer is smaller than that of the finely-divided particles of said thermofusible material in said first ink layer.

15. The thermal image transfer recording medium as claimed in claim 13, wherein the average particle diameter of said finely-divided particles of said thermofusible material in said second ink layer is in the range of 0.15 to 0.35 μm.

16. The thermal image transfer recording medium as claimed in claim 12, wherein 75 wt. % or more of the finely-divided particles of said thermofusible material contained in said first ink layer have particle diameters in the range of 0.5 to 3.0 μm based on the entire weight of said thermofusible material in said first ink layer.

17. The thermal image transfer recording medium as claimed in claim 12, wherein said thermofusible material comprises a wax component.

18. The thermal image transfer recording medium as claimed in claim 17, wherein said thermofusible material further comprises a resin component.

19. The thermal image transfer recording medium as claimed in claim 12, wherein said thermofusible material comprises a wax component and a resin component.

20. The thermal image transfer recording medium as claimed in claim 17, wherein said wax component is selected from the group consisting of paraffin wax, microcystalline wax, oxidized paraffin wax, candelilla wax, carnauba wax, montan wax, cersine wax, polyethylene wax, oxidized polyethylene wax, castor wax, beef tallow hardened oil, lanolin, Japan wax, sorbitan stearate, sorbitan palmitate, stearyl alcohol, polyamide wax, oleylamide wax, stearylamide, hydroxystearic acid, synthesized ester wax and synthesized lanolin derivative wax.

21. The thermal image transfer recording medium as claimed in claim 18, wherein said resin component is selected from the group consisting of rubber elastomer, polyamide-based resin, polyester-based resin, polyurethane-based resin, vinyl chloride-based resin, cellulose-based resin, petroleum-based resin, styrene-based resin, butyral-based resin, phenolic resin, ethylene-vinyl acetate copolymer, ethylene-acrylic resin, and terpene resin.

22. The thermal image transfer recording medium as claimed in claim 19, wherein the amount ratio by weight of said coloring agent, said wax component and said resin component in said second ink layer is in the range of 5–50/30–90/5–50.

* * * * *

UNITED STATES PATENT AND TRADEMARK OFFICE

CERTIFICATE OF CORRECTION

PATENT NO. : 5,362,548

DATED : November 8, 1994

INVENTOR(S) : Yoshihiko HIYOSHI et al

It is certified that error appears in the above-indentified patent and that said Letters Patent is hereby corrected as shown below:

Column 5, line 58, delete second "and".

Column 7, line 38, "50-50/" should read --51-50/--.

Column 8, line 65, delete fourth "the".

Column 24, line 65, before "solid" insert --(--.

Column 25, line 51, before "Trademark" insert --(--.

Signed and Sealed this

Thirtieth Day of April, 1996

*Attest:*

*Attesting Officer*

Bruce Lehman

BRUCE LEHMAN

*Commissioner of Patents and Trademarks*